US005469798A

United States Patent [19]

Gauch

[11] Patent Number: 5,469,798

[45] Date of Patent: Nov. 28, 1995

[54] THREAD CUTTING DEVICE AND METHOD FOR A CHAIN STITCH SEWING MACHINE

[75] Inventor: Hermann Gauch, Möglingen, Germany

[73] Assignee: Union Special GmbH, Hemmingen, Germany

[21] Appl. No.: 274,545

[22] Filed: Jul. 13, 1994

[30] Foreign Application Priority Data

Jul. 14, 1993 [DE] Germany ..... 43 23 494.1

[51] Int. Cl.[6] ..... D05B 65/00

[52] U.S. Cl. ..... 112/298; 112/475.01

[58] Field of Search ..... 112/288, 291, 112/292, 293, 295, 298, 299, 262.1; 83/905

[56] References Cited

U.S. PATENT DOCUMENTS

| | | | |
|---|---|---|---|
| 2,421,712 | 6/1947 | Nichols | 112/298 |
| 3,532,065 | 10/1970 | Marforio | 112/292 |
| 4,098,209 | 7/1978 | Schopf | 112/298 |
| 4,726,305 | 2/1988 | Seto | 112/298 |
| 5,337,688 | 8/1994 | Arima | 112/298 |

FOREIGN PATENT DOCUMENTS

| | | | |
|---|---|---|---|
| 2-126578 | 10/1990 | Japan . | |
| 3114495 | 5/1991 | Japan | 112/292 |
| 1119955 | 7/1968 | United Kingdom | 112/292 |

*Primary Examiner*—Jeanette E. Chapman
*Attorney, Agent, or Firm*—Willian Brinks Hofer Gilson & Lione

[57] ABSTRACT

A thread cutting device for a chain-stitch sewing machine having a cylindrical arm (2) moves a thread catcher (14) towards a thread-catching position in a jerk-free manner utilizing a sliding and pivoting guide. A carrier (19) displaces a knife (15) and a thread clamp (16) into a cutting position for the cutting of threads caught by the thread catcher (14).

17 Claims, 5 Drawing Sheets

THREAD CUTTING DEVICE AND METHOD FOR A CHAIN STITCH SEWING MACHINE

BACKGROUND OF THE INVENTION

The invention relates to a thread cutting device for a chain stitch sewing machine.

A thread cutting device in accordance with U.S. Pat. No. 4,098,209 has three guideways in the form of slots which cooperate with further guide parts in such a way that a thread catcher is moved towards a catching position parallel to the back of a looper and beyond a knife restrained by means of a stop and from there back into an inoperative position adjacent to the path of movement of the looper. The construction of these guideways is expensive and might lead to premature wear on the guides.

A further thread cutting device is known from U.S. Pat. No. 4,726,305 in which guides make a similar path of movement of the thread catcher possible. In this case, the transition of the path of movement of the thread catcher from the arcuate to the linear phase is effected abruptly, and might also lead to premature wear on the guides or to undesired vibration of the thread catcher.

The JP Utility Model Hei 2-126578 discloses a further embodiment of a thread cutting device. Here also, the transition of the path of movement of the thread catcher from the arcuate to the linear phase is abrupt. This might also lead to undesired vibration of the thread catcher.

Thus, an object of the invention is to develop a thread cutting device in such a way that the path of movement of the thread catcher into the catching position and back into the cutting position and then into the inoperative position is as smooth as possible.

SUMMARY OF THE INVENTION

The present invention resides in a thread cutting device for a chain-stitch sewing machine, having a cylindrical arm with a workpiece support and a looper which is displaceable at right angles to the feed direction of the workpiece and is pivotable in the feed direction of the workpiece for the purpose of receiving loops, wherein a) a movable, guided thread catcher is disposed between the looper and the workpiece support and cooperates with a knife and a thread clamp;

b) the thread catcher is part of a drive member;

c) the drive member is in the form of a driver for a carrier for the knife and the thread clamp, which driver during part of its movement towards an inoperative position positively moves the carrier;

d) the drive member has guides by which it cooperates with guide means in such a way that the thread catcher is moved towards a catching position parallel to the back of the looper and beyond the knife and from there back into the inoperative position adjacent to the path of movement of the looper;

e) the knife is restrained in its path of movement towards the looper by means of a stop;

f) one of the guides of the drive member is displaceably connected to a guide piece fixed relative to the arm;

g) one end of a guide link pivots about a guide point fixed relative to the arm, g1) the other end of the guide link carries a guide which is operatively connected to the further guide of the drive member;

h) the guide is operatively connected to the carrier in such a way that the transition from the pivoting movement of the guide link into the substantially linear sliding movement of the drive member is effected substantially tangentially to the path of the guide link, and i) the carrier and the drive member form a sliding guide.

By virtue of the arrangement of a guide of a drive member displaceably and pivotably connected to a guide piece fixed relative to the arm, and a guide link which is pivoted at one end about a guide point in the form of a pivot bearing fixed relative to the arm, the other end of which guide link carries a guide in the form of a collar stud, the guide cooperating with the drive member and the carrier, the transition from the arcuate pivoting movement of the guide link to the substantially linear or sliding movement of the drive member is effected substantially tangentially to the movement of the end of the guide link. This results in virtually a jerk-free transitions from the arcuate phase to the linear phase of the thread catcher.

BRIEF DESCRIPTION OF THE DRAWINGS

The invention will be further described hereinafter by way of example with reference to the drawings, in which.

DETAILED DESCRIPTION OF THE PREFERRED EMBODIMENTS

Figure 1:
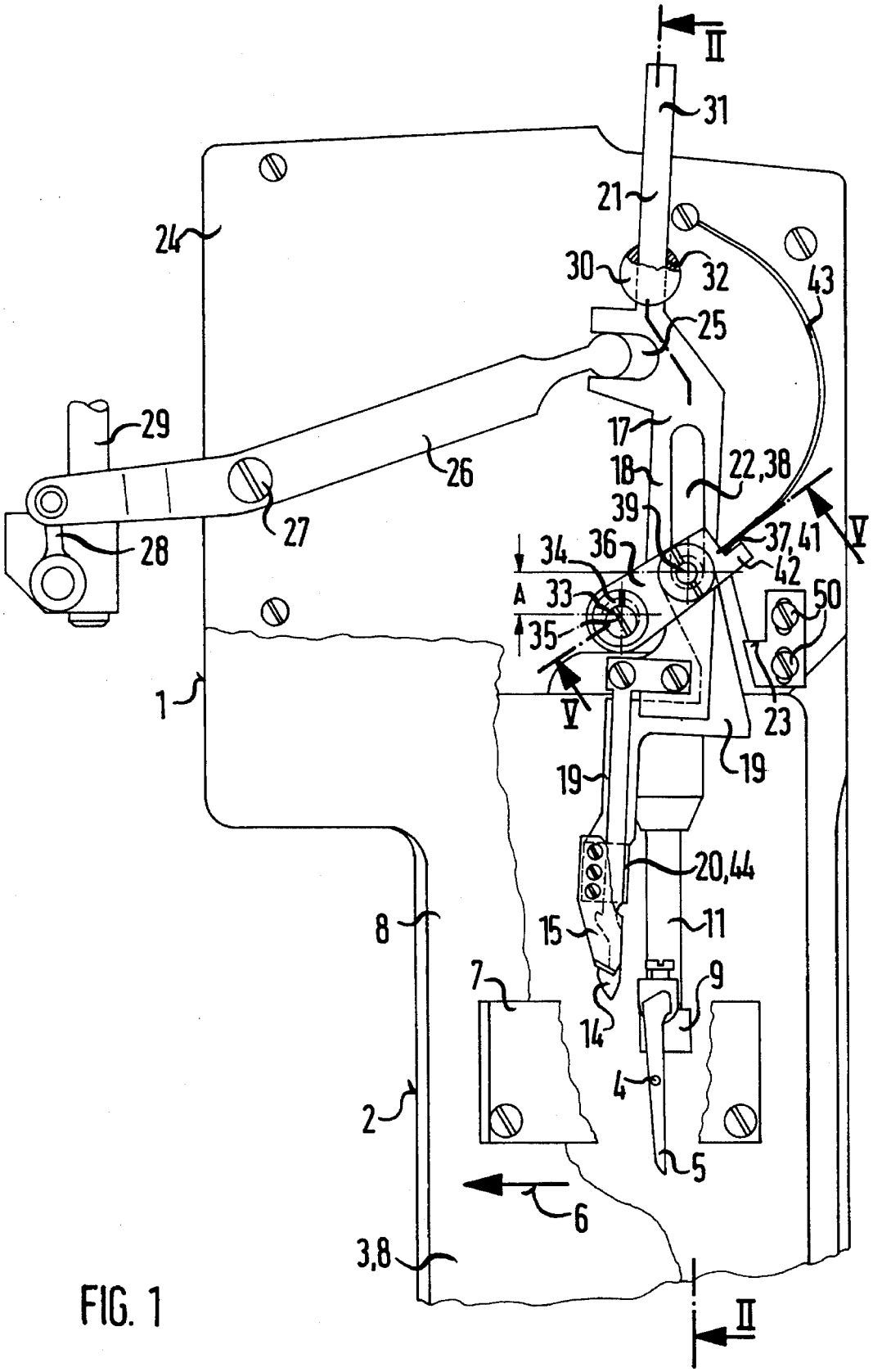
FIG. 1 is a plan view of a portion of a partially open machine bed, with a thread cutting device in an inoperative position.

Referring to FIG. 1, a machine bed 1 of a chain-stitch sewing machine merges into a cylindrical arm 2 having a workpiece support 3. The sewing machine has a sewing needle 4 which is driven in a known manner. The thread-guiding sewing needle 4 cooperates with a thread-guiding looper 5 in order to form chain stitches. Also shown in FIG. 2, the looper 5 is disposed below a needle plate 7 which is secured in a cover 8 of the workpiece support 3. The looper 5 is displaceable in the cylindrical arm or housing 2 at right angles to the workpiece feed direction, indicated by an arrow 6, for the purpose of receiving loops and is pivotable in the workpiece feed direction. The looper 5 is secured in a holder 9 carried by a displaceably and pivotably driven looper shaft 11 in order to impart to the looper 5 the required loop-receiving movement and needle avoidance movement relative to the sewing needle 4 moving along a needle path 12. It is also known to dispose a plurality of needles 4 transversely to the workpiece feed direction, as indicated by the further needle path 13. The workpiece feed device, also provided in the machine bed 1, for advancing the workpiece has been omitted.

Figure 2:
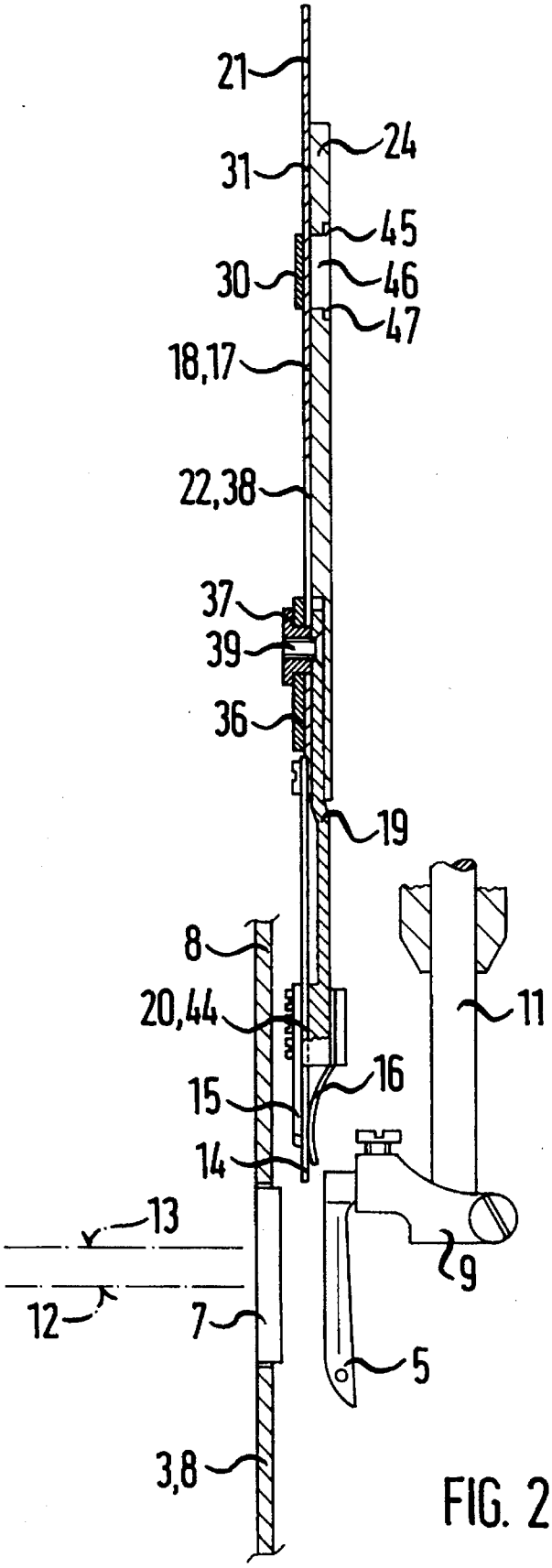
FIG. 2 is a detail cross section, taken on the line II—II of FIG. 1.

The thread cutting device is shown in an inoperative position in FIGS. 1 and 2. The thread cutting device is a withdrawable and laterally movable device of which a movable thread catcher 14 is disposed between the looper 5 and the workpiece support 3 and cooperates with a knife 15 and a thread clamp 16 by being guided between the knife 15 and the thread clamp 16. The thread catcher 14 is releasably connected to a slide 17 which is a part of a drive member and moves the thread catcher 14 towards and away from the stitch-forming zone. The drive member, (hereinafter referred to as "slide 17") is in the form of a driver 18 for a carrier 19 for the knife 15 and the thread clamp 16, for retracting the carrier 19 relative to the thread catcher 14 positively to a restricting position. This means that the carrier 19 performs only the movement path of the knife 15 and thus only performs part of the movement path of the slide 17, the carrier 19 being guided by means of a groove 20 surrounding the thread catcher 14. The slide 17 having guides 21 and 22 cooperates with guide means in such a way that the thread catcher 14 moves towards a catching position (FIGS. 3 and 4) parallel to the back of the looper 5 and beyond the knife 15, and from there back to the inoperative position adjacent to the path of movement of the looper 5. In its path of movement towards the looper 5, the knife 15 is retained in its cutting position of FIG. 3 by means of a stop 23.

The slide 17 is movably disposed on a base plate 24. Furthermore, the slide 17 has an opening 25 which is engaged by the end of a drive lever 26. The drive lever 26 is pivotably mounted on the base plate 24 at a point 27 in the form of a collar screw and is connected by way of drive link 28 to a rod 29 which leads to a drive unit (not shown) such as an electromagnet or piston drive which, for example, prescribes the inoperative position of the thread catcher 14. The guide 21 is displaceably received in a guide piece 30 which is fixed relative to the machine bed 1 and which is pivotably mounted in the base plate 24. Alternatively, instead of the flat bar 31, shown in the drawing, which extends through an opening 32 in the guide piece 30, the guide 21 may be in the form of a slot through which a screw, secured in the base plate 24, engages.

Figure 5:
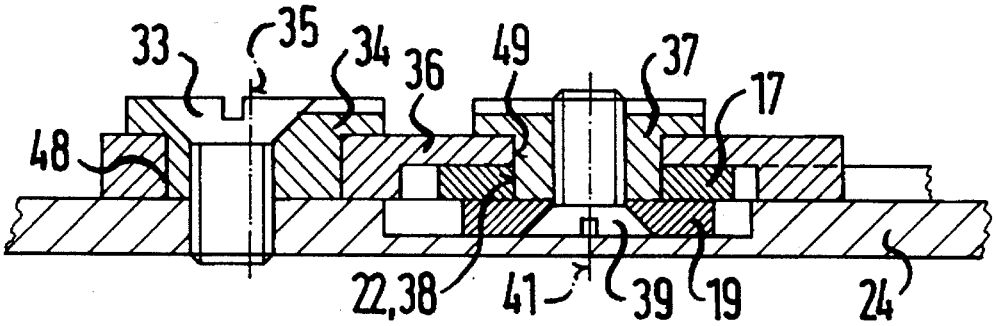
FIG. 5 is a detail cross section, taken on the line V—V of FIG. 1.

As shown in FIG. 5, a guide location, also fixed relative to the housing is established by means of a screw 33, behind the slide 17 in the workpiece feed direction, that is to the same part of the base plate 24 on which the pivot 27 for the drive lever 26 is located. The guide location is in the form of an eccentric collar 34 which serves as a pivot bearing 35 for a guide link 36 and, by reason of its eccentricity, makes it possible to adjust the catcher path laterally towards the needle path 12. A guide in the form of a collar stud 37 passes through the end of the guide link 36 facing the slide 17 or the carrier 19, as well as through the further guide 22 which is in the form of an inclined slot 38 in the slide 17. The collar stud 37 is rigidly connected to the movable carrier 19 from below by means of a screw 39, so that the slide 17 is displaceably mounted, and the carrier 19 follows the pivoting movement of the guide link 36 and thus the path of the guide link.

The collar stud 37 forms a pivot point 41 for the carrier 19. The pivot point 41, which has moved away from the looper when in the inoperative position, on the carrier 19 is disposed at a distance A from the pivot bearing 35, fixed relative to the housing, towards the looper. In the ideal case, the distance A decreases to zero when the knife 15 reaches its cutting position and the thread catcher 14 changes from its arcuate or pivoting phase to its linear or sliding phase. Since the height of the arc of the path of the guide link is low in the region of the cutting position, a range of adjustment of the stop 23, and thus also a range of adjustment of the catching position, of several millimeters is possible.

The end of the guide link 36 facing the carrier 19 has a projection 42 upon which acts a spring 43 which is secured to the base plate 24 and which urges the projection 42 of the guide link 36 against the stop 23. The slide 17 and the collar stud 37 hold the carrier 19, against the force of the spring 43, in the inoperative position which is predetermined by, for example, an adjustable end position of the rod 29.

The groove 20 of the carrier 19, together with the thread catcher 14 which, together with the slide 17, constitutes the drive member, form a slide guide 44, which, together with the pivoting path of the guide link 36 and the stop 23, determines the cutting position of the knife 15.

FIG. 2 shows the mounting of the slide 17 in the guide piece 30 which, corresponding to the width of the flat bar 31, has a slot 45 in which the flat bar 31 is slidably guided. The guide piece 30 is axially positioned in an opening 46 in the base plate 24 by means of a collar 47. The thread catcher 14, the knife 15 and the thread clamps 16 are shown in their inoperative positions.

Figure 3:
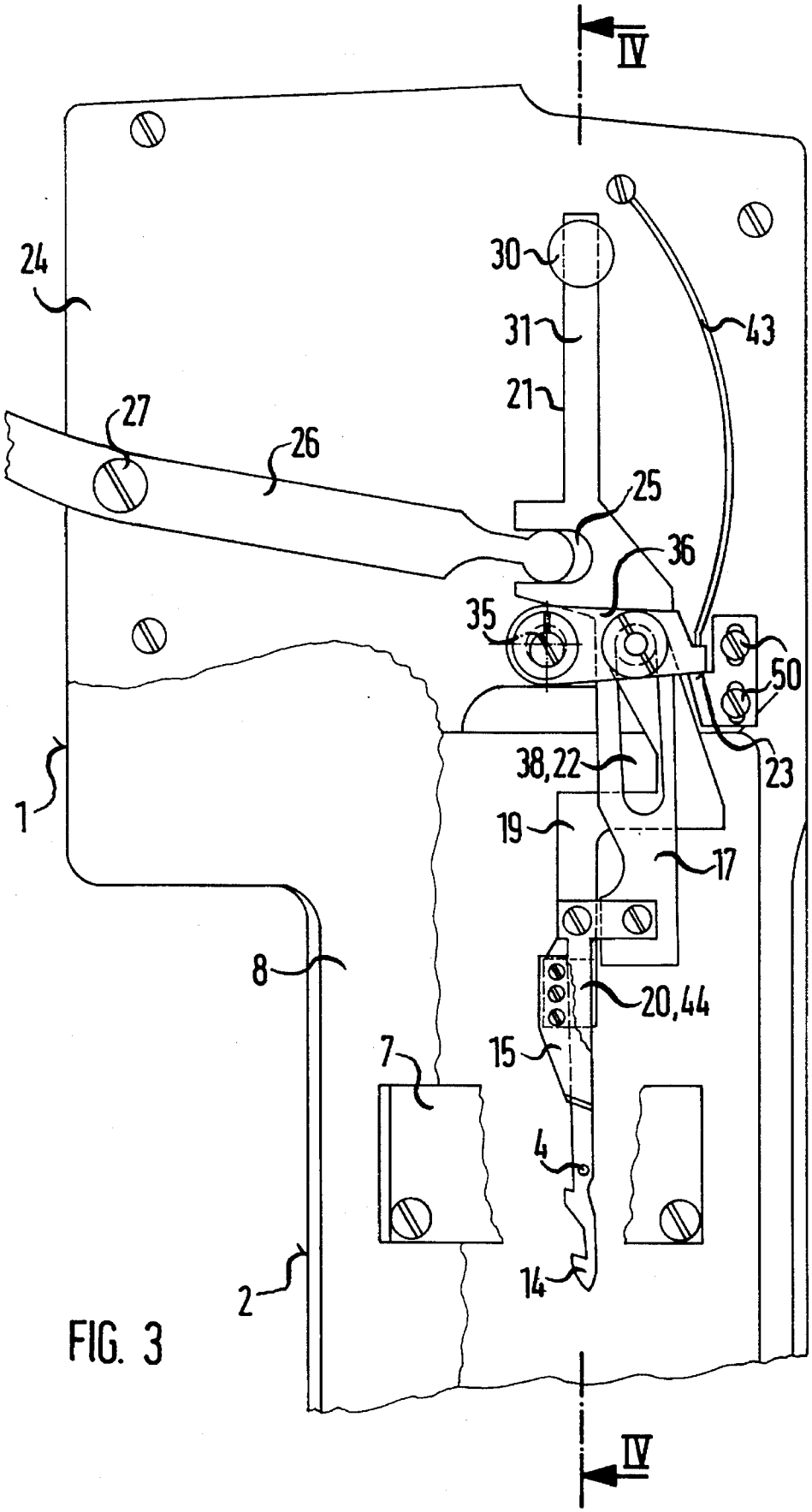
FIG. 3 is a plan view, similar to FIG. 1, with the thread catcher extended in its catching position.

Referring to FIG. 3, the guide link 36 is pivoted against the stop 23, and thus the knife 15 is displaced into its cutting position, since the carrier 19 carrying the knife 15 is displaced relative to the pivot bearing 35. The thread catcher 14 is shown in its catching position beyond the knife 15.

Figure 4:
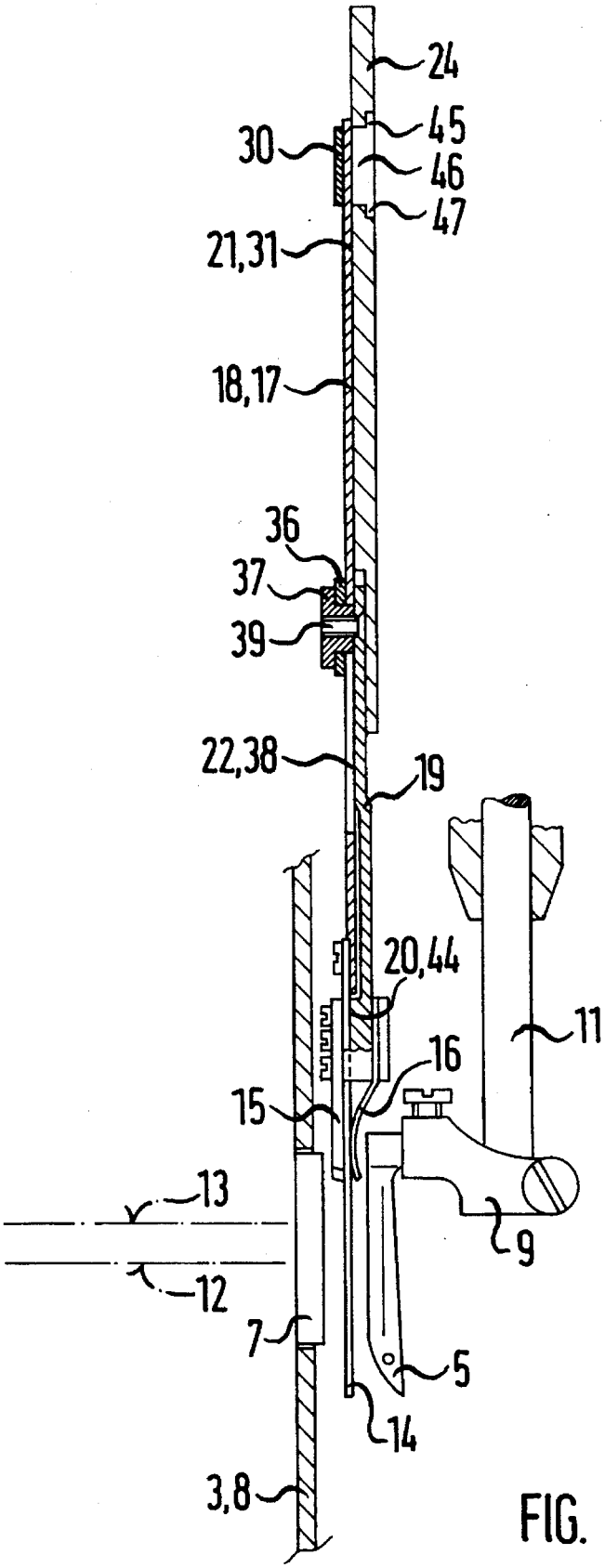
FIG. 4 is a detail cross section, taken on the line IV—IV of FIG. 3.

FIG. 4 shows the thread catcher 14, movable in the groove 20 between the needle plate 7 and the looper 5, in its catching or working position, and the knife 15 and the thread clamp 16, in their cutting and clamping positions respectively.

FIG. 5 shows the mounting of the guide link 36. An opening 48 in the guide link 36, together with the collar eccentric 34, form the pivot bearing 35. A further opening 49 in the guide link 36 makes it possible for the collar stud 37 to rotate in the guide link 36, and thus for the carrier 19 to pivot about the pivot point 41.

Figure 6:
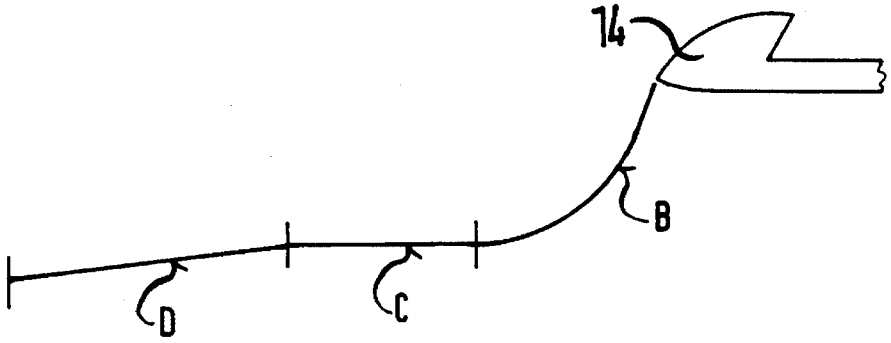
FIG. 6 shows an optimum movement path of a thread catcher with additionally angled guideway.

FIG. 6 shows the substantially jerk-free tangential transition of the arcuate path B of the thread catcher 14 to the substantially linear sliding path C of the thread catcher. The angled guide path D results on the basis of an angled guide path of, for example, the inclined slot 38. The additionally angled guide path D of the thread catcher 14 makes possible even more accurate guidance of the thread catcher 14 towards the catching position relative to the thread loops (not shown).

The mode of operation of the thread cutting device is as follows:

Starting from the inoperative position in FIG. 1, the drive lever 26 pivots in a clockwise direction about the pivot 27. At the same time, the slide 17 moves towards the looper 5, and the spring 43 urges the projection 42 on the guide link 36 against the stop 23 adjustably secured by means of screws 50. The carrier 19 with the knife 15 and the thread clamp 16 are thereby also carried along, by means of an arcuate movement about the pivot bearing 35, into the cutting position (FIGS. 3 and 4) which, furthermore, results from the arresting of the carrier 19 in the slide guide 44. The thread catcher 14 then enters its linear phase into the catching or working position which is prescribed by the length of the slot 38 and by the adjustable stop 23. At the same time, the slide 17 is slidingly guided by its guide 21 in the guide piece 30 on the one hand and, on the other hand, by means of its slot 38 through which the stud 37 engages. The knife 15 aligns itself corresponding to the movement path of the thread catcher 14, since the knife follows the movement path of the groove 20 which is formed as part of the carrier 19 and in which the thread catcher 14 is displaceably disposed.

The thread catcher 14 is returned into its inoperative position by pivoting of the drive lever 26 in an anti-clockwise direction. The thread catcher 14 is first drawn into the cutting position of the knife 15. After the threads have been cut and clamped, the thread catcher 14, together with the knife 15 and the thread clamps 16, move into the inoperative position which is predetermined by means of a stop (not shown in the drawings) for the drive member. At the same time, the slide 17 serves as the driver 18 which pulls the carrier 19, against the force of the spring 43, into the inoperative position adjacent to the movement path of the looper, as shown in FIG. 1.

I claim:

1. A thread cutting device for a chain-stitch sewing machine, having a cylindrical arm with a workpiece support and a looper which is displaceable at right angles to the feed direction of the workpiece and is pivotable in the feed direction of the workpiece for the purpose of receiving loops, comprising:

a) a drive member, having a distal end and a proximal end, attached to a movable, guided thread catcher, wherein the thread catcher is disposed between the looper and the workpiece support at the distal end of the drive member, and the thread catcher cooperates with a knife and a thread clamp;

b) the drive member is coupled by a collar stud to a carrier upon which the knife and the thread clamp are mounted, the drive member being movable between a thread catching position and an inoperative position, wherein the drive member, during part of its movement, positively moves the carrier toward the looper;

c) the drive member has a plurality of guides with which it cooperates in such a way that the thread catcher is moved towards the catching position parallel to the looper and beyond the knife and from there back into the inoperative position;

d) the carrier, and the knife mounted thereto, is restrained in its movement toward the looper by a stop that is mounted to the sewing machine;

e) a first guide from the plurality of guides is fixed relative to the arm, wherein the first guide displaceably receives the proximal end of the drive member;

f) a second guide from the plurality of guides comprises a guide link, wherein one end of the guide link pivots about a point fixed relative to the arm;

g) an opposite end of the guide link carries the collar stud which is operatively connected to the drive member to allow the drive member to move in a substantially linear manner about the collar stud, the collar stud moving along an arcuate path as the guide link pivots; and h) the collar stud is operatively connected to the carrier in such a way that, as the drive member moves the thread catcher toward the catching position, the transition from the pivoting movement of the guide link into the substantially linear movement of the drive member is effected substantially tangentially to the arcuate path of the collar stud on the guide link.

2. A thread cutting device as claimed in claim 1, wherein the guide link pivots about a laterally adjustable pivot bearing.

3. A thread cutting device as claimed in claim 2, wherein the laterally adjustable pivot bearing comprises an eccentric collar.

4. A thread cutting device as claimed in claim 1, wherein the drive member comprises a slide having an inclined slot.

5. A thread cutting device as claimed in claim 4, wherein the collar stud projects through the inclined slot, the collar stud being rigidly connected to the carrier.

6. A thread cutting device as claimed in claim 5, wherein the inclined slot in the drive member causes the drive member to deviate from the substantially linear movement as the drive member moves the thread catcher toward the catching position.

7. A thread cutting device as claimed in claim 1, wherein the thread catcher is slidably disposed within a groove formed in the carrier.

8. A thread cutting device as claimed in claim 1, in which the stop is adjustably secured to a base plate.

9. A method of cutting a chain stitch sewing stitch, comprising the steps of:

providing a thread cutting device having a slide in operative association with a guide link fixed to a carrier, a thread catcher attached to a distal end of the slide, a knife attached to a distal end of the carrier, and means for urging the guide link against a stop, wherein the guide link is pivotably fixed at one end to a base;

rotating the guide link about its pivotably fixed end by driving the slide, and the thread catcher attached thereto, in a first direction whereby the urging means directs the guide link toward the stop, thereby moving the thread catcher and the knife along an arcuate path;

stopping the rotation of the guide link when the knife reaches a cutting position;

continuing to drive the slide, and the thread catcher attached thereto, in the first direction thereby moving the thread catcher along a substantially linear path tangential to the arcuate path, whereby the thread catcher is displaced from the knife for catching the sewing stitch;

reversing the drive direction to draw the thread catcher to the knife; and cutting the sewing stitch with the knife.

10. An apparatus for cutting a thread chain, comprising:

a movable cutting assembly comprising:

a slide having a slot, a guide link having a first end and a second end, wherein the first end is pivotably mounted to a base and the second end is coupled to the slide through the slot, the second end of the guide link being movable about the pivotably mounted first end along an arcuate path, a thread catcher attached to a distal end of the slide, a carrier attached to the second end of the guide link, and a knife attached to a distal end of the carrier;

a stop positioned adjacent to the movable cutting assembly to engage the guide link at a predetermined position;

means for urging the guide link toward the stop; and means, coupled to the slide, for driving the movable cutting assembly, the driving means operable to move the thread catcher of the cutting assembly along a path between an inoperative position and a thread catching position;

wherein the path of the thread catcher comprises an arcuate portion corresponding to the arcuate path of the second end of the guide link, and a substantially linear portion tangential to the arcuate portion, the substantially linear portion being determined by the slot.

11. An apparatus as claimed in claim 10, wherein the cutting assembly further comprises a thread clamp attached to the carrier.

12. An apparatus as claimed in claim 10, wherein the urging means comprises a spring.

13. An apparatus as claimed in claim 10, wherein the guide link is coupled to the slide by a collar stud passing through the second end of the guide link and the slot, the collar stud being rigidly connected to the carrier.

14. An apparatus as claimed in claim 13, wherein the guide link is pivotably mounted to the base by a pivot bearing.

15. An apparatus as claimed in claim 14, wherein the stop is adjustably positioned.

16. An apparatus as claimed in claim 15, wherein the stop is positioned to engage the guide link when the pivot bearing and the collar stud are aligned with a workpiece feed direction.

17. An apparatus as claimed in claim 10, wherein at least a portion of the slot is inclined with respect to a line transverse to a workpiece feed direction.

* * * * *